US008523376B2

(12) United States Patent
Motyka et al.

(10) Patent No.: US 8,523,376 B2
(45) Date of Patent: Sep. 3, 2013

(54) SELF-DEFENSE WALKING AID

(75) Inventors: John D. Motyka, Yardly, PA (US); Bruce E. McCoy, Sharon, VT (US)

(73) Assignee: John D. Motyka, Yardley, PA (US)

( * ) Notice: Subject to any disclaimer, the term of this patent is extended or adjusted under 35 U.S.C. 154(b) by 152 days.

(21) Appl. No.: 13/268,131

(22) Filed: Oct. 7, 2011

(65) Prior Publication Data

US 2012/0140450 A1 Jun. 7, 2012

Related U.S. Application Data

(60) Provisional application No. 61/419,905, filed on Dec. 6, 2010.

(51) Int. Cl.
*A45B 3/02* (2006.01)
*A45B 3/04* (2006.01)
*A45B 3/00* (2006.01)

(52) U.S. Cl.
USPC ..... 362/102; 362/297; 361/232; 135/65; 135/66

(58) Field of Classification Search
USPC ..... 362/102, 297; 231/7; 463/47.3, 463/47.4; 361/232
See application file for complete search history.

(56) References Cited

U.S. PATENT DOCUMENTS 2,561,122 A 7/1951 Juergens
3,819,108 A * 6/1974 Jordan ..... 231/7
3,885,733 A 5/1975 Klebold et al.
4,093,969 A 6/1978 Maynor, Jr.
4,842,277 A 6/1989 LaCroix
5,041,951 A 8/1991 Fan
D325,297 S 4/1992 Lipscomb et al.
5,388,603 A 2/1995 Bauer et al.
5,839,461 A * 11/1998 Lambeth, Jr. ..... 362/102
5,845,986 A 12/1998 Breen
6,394,116 B1 5/2002 Winn et al.

(Continued)

FOREIGN PATENT DOCUMENTS

JP 2005230487 A * 9/2005
JP 2006218259 A * 8/2006
JP 2011239992 A * 12/2011

OTHER PUBLICATIONS

Adam Frucci, "Exclusive Interview: Steampunk Virtuoso Datamancer, aka Rich Nagy, Shows Us His 'Tesla Cane'", Nov. 15, 2007, Gizmodo downloaded from: http://gizmodo.com/322687/exclusive-interview-steampunk-virtuoso-datamancer-aka-rich-nagy-shows-us-his-tesla-cane.

*Primary Examiner* — Mariceli Santiago
(74) *Attorney, Agent, or Firm* — Michael J. Weins; Jeffrey E. Semprebon

(57) ABSTRACT

A cane or similar walking aid incorporates a concealed electrical self-defense device having electrodes located at the tip region of the cane, and may also incorporate an annular light source to aid the user. A grip is attached to a support shaft which terminates in a tip that is fabricated of an elastomer and incorporates electrodes for the electrical deterrent. The tip electrodes can be fabricated from a conductive elastomer to avoid scratching or marring floor surfaces as well as to provide resistance to slipping. When the shaft has both tip electrodes and side electrodes positioned along the exterior surface of the support shaft, the separation of the side electrodes can be adjusted to provide preferential arcing between the side electrodes to provide a visual and audible deterrent and to avoid premature deterioration of the conductive elastomer tip electrodes.

13 Claims, 8 Drawing Sheets

(56) References Cited

U.S. PATENT DOCUMENTS

| | | | | |
|---|---|---|---|---|
| 6,439,432 | B1 | 8/2002 | Park | |
| 6,951,415 | B2 | 10/2005 | Amano et al. | |
| 7,267,453 | B2 | 9/2007 | Chang et al. | |
| 7,575,334 | B2 | 8/2009 | Becnel | |
| 2009/0199884 | A1 * | 8/2009 | Lessing | 135/66 |
| 2010/0319740 | A1 * | 12/2010 | Willey | 135/66 |

* cited by examiner

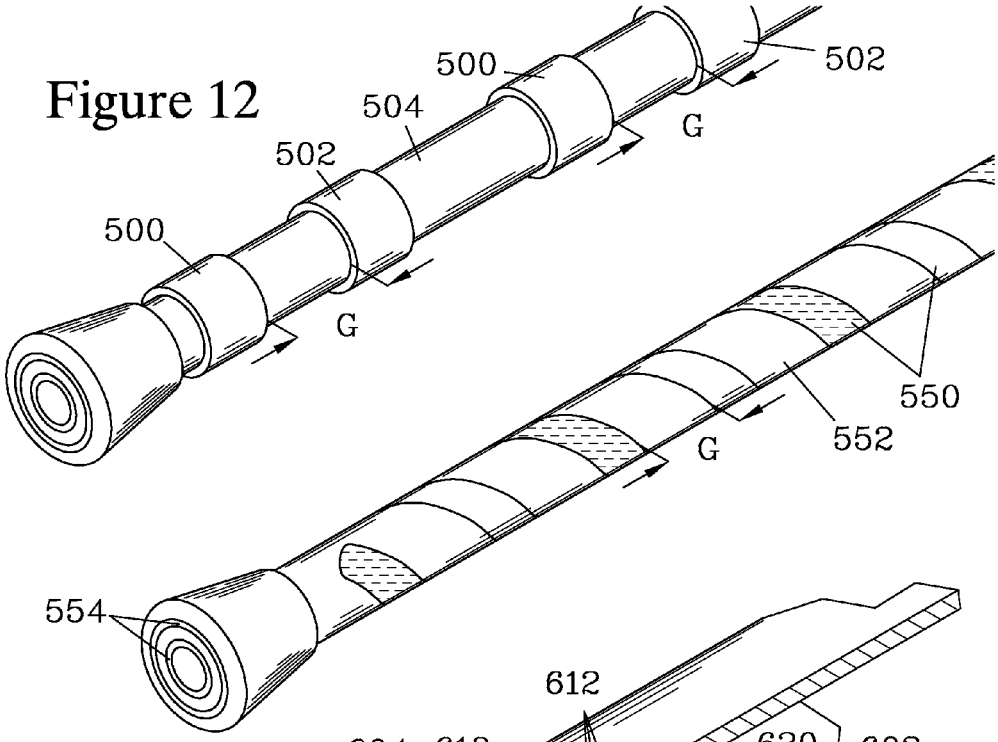
Figure 12
Figure 13
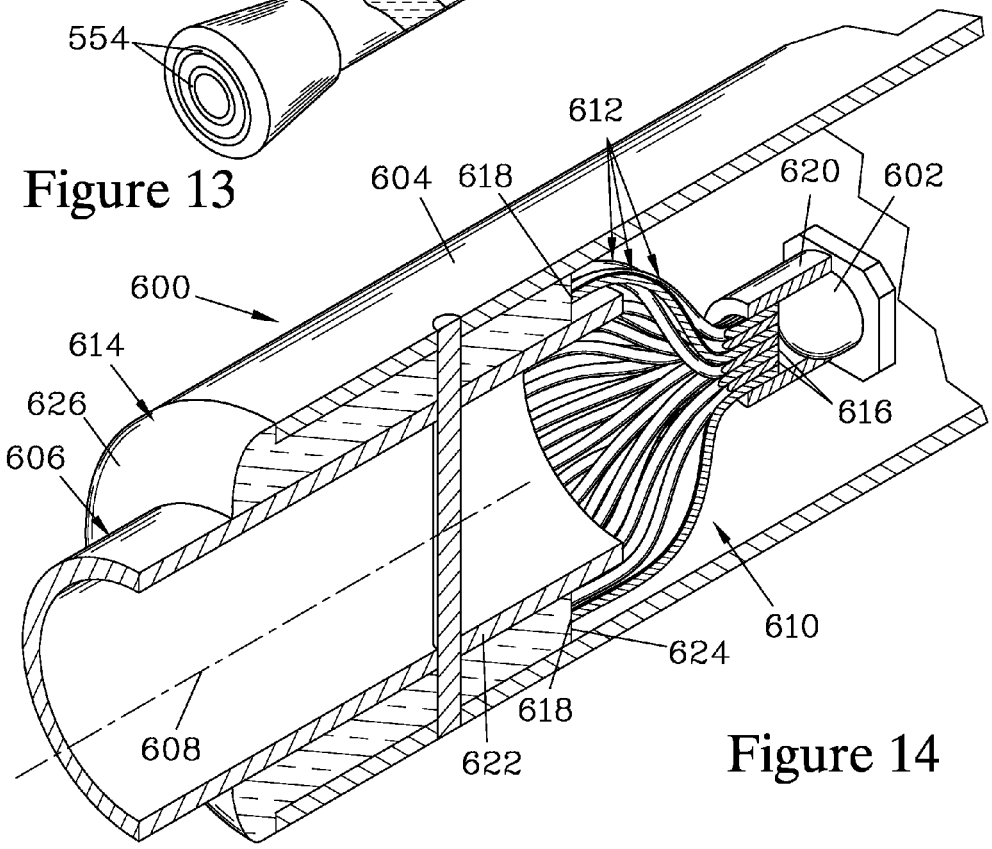
Figure 14

SELF-DEFENSE WALKING AID

FIELD OF THE INVENTION

The present invention relates to self-defense devices that employ an electrical deterrent to discourage attackers, and relates particularly to a device that also provides support for individuals to aid in walking.

BACKGROUND OF THE INVENTION

Security against attack is a concern for many individuals, and is of particular concern for those who need assistance walking; such individuals may be more likely to be targeted by attackers due to their impaired physical ability.

One approach to deterring and countering attacks is to employ a device that generates a high electrical voltage. Such devices may be able to deter an attack by presenting a threatening electrical discharge display, and if the attack continues, electrodes of the device can be applied to the body of the attacker to interrupt the attack. Two such devices are taught in U.S. Pat. Nos. 5,041,951 and 6,439,432, each of which also incorporates a flashlight and a chemical spray for use when an attacker is at a distance. Including a chemical spray for use against attackers at longer range may restrict the locations where the device may be legally carried.

Electrical deterrent devices may be elongated so as to extend the reach of the user to allow the electrodes to contact the attacker before the attacker can get close enough to grasp the user. One elongated electrical device is taught in U.S. Pat. No. 3,885,733, which teaches an electric prod for animals which also incorporates a flashlight. Elongated devices intended for use against attackers are taught in U.S. Pat. Nos. 4,093,969 and 5,388,603, both of which teach electric deterrent devices that are incorporated into collapsible umbrellas to disguise the device. These two devices can employ configurations of electrodes having both electrodes on the tip of the device, for pushing into contact against an attacker, and electrodes extending on the side of the device to prevent an attacker from grasping the device to disarm the user. While these devices may be effective in deterring attacks, the ability to disguise the device is limited; if the device is carried in dry weather when rain is not expected, the disguise may be ineffective.

Furthermore, none of the above devices serve to provide support for the user when walking, which is frequently desirable for elderly or otherwise physically impaired persons. One cane which appears to incorporate electrodes along the shaft is illustrated in U.S. Pat. Des. 325,297. However, the device is not disguised, and thus a potential attacker may be alerted to the presence of the defensive device and be able to take precautions before attacking. It has been suggested that retractable electrodes might be employed to extend from the tip of a cane, but it is unknown whether such a device has been effectively implemented.

As noted above, some electrical devices incorporate a flashlight. While flashlights such as taught in the '951 and '432 patents may be useful to identify a potential attacker, if such a light is employed with an elongated device such as taught in the '951 patent, the distribution of light will be limited by shadowing, since the light is only provided on one side of the device. Devices have been developed to provide lighting for a shaft-mounted tool while avoiding shadows caused by the shaft. Such devices employ an array of 2 or more LED lamps on a device attached to a shaft of the tool, with the LED lamps positioned in a radial array about the longitudinal axis of the shaft, as taught in U.S. Pat. Nos. 5,845,986 and 7,575,334. These devices are designed to provide light only a short distance to illuminate the tip of the tool to facilitate its use in darkened environments, and thus the intensity and distribution of the light provided can be very limited compared to the intensity and distribution of light that would be desirable to identify a potential attacker in a darkened environment.

SUMMARY OF THE INVENTION

The present invention is for a cane or walking stick (hereinafter referred to simply as a cane) for assisting a user in traversing ground and floor surfaces and which incorporates an electrical self-defense device that is concealed and does not affect the primary function of providing support when the cane is in normal use. The electrical self-defense device has electrodes located at the tip region of the cane so as to extend the reach of the user when attempting to parry or fend off an attacker. The cane may also incorporate a light source to aid the user in identifying a potential aggressor in darkened environments. Such a light source also has utility by itself in that it can illuminate the ground surface so as to avoid obstacles and aid the user in planting the cane tip on a suitable location on the underlying surface for providing stable support.

The cane of the present invention has a grip which is attached to a support shaft which in turn terminates in a tip region. A cane tip fabricated of an elastic material is mounted on the tip region of the support shaft. The cane tip terminates in a support surface which is designed to grippably engage the underlying surface on which it rests when a downward force is applied to the cane tip by a user when supplemental support is being sought.

A pair of tip electrodes are embedded in the cane tip and preferably are positioned with respect to the tip such they are exposed in the support surface, so as to be exposed with respect to a surface or object advancing toward the support surface. Preferably, these tip electrodes reside at or in close proximity to the support surface, and can be slightly protruding or recessed with respect to the support surface. An energizing circuit creates a high-voltage potential between the tip electrodes. When so energized, a discharge of these electrodes onto an aggressor will stun the aggressor and forestall the aggressor's advance. It is further preferred that the pair of electrodes provided in the cane tip be nested and aligned with the support shaft.

It is preferred that the tip electrodes be fabricated from a conductive elastomer so as to provide a fully flexible cane tip that can interact with the ground or floor surface with which it is engaged without scratching or marring the surface, as well as providing resistance to slipping so as to enable the cane to provide support when needed by the user. This is particularly desirable when the tip electrodes protrude from the support surface to help assure that they make contact with the body of an attacker when the cane tip is pushed against the attacker. When such a elastomer conductors are used, they can be backed with metal disks or washer elements so that the elastomer conductors are at a constant potential and can be readily connected to wiring leading to the energizing circuit. These metal elements also tend to distribute the load in the elastic tip and provide the same function as the metal element typically employed in medical supply quality cane tips.

Means for energizing the electrodes are provided by the energizing circuit in combination with an energy source such as one or more batteries. Such batteries and energizing circuitry are known in the art, and typically employ an oscillator to convert the battery power to an AC current which is then provided to a series of step-up transformers to increase the voltage, with the secondary winding of the last transformer being connected to the electrodes. The energizing circuit may be housed in the grip or in the shaft, and are typically arranged so as to provide a desirable distribution of the cane's weight for balance purposes. The location of the batteries will frequently be selected to provide ready access to allow replacing the batteries if necessary. To serve as additional deterrence, the electrodes can be spaced apart such that, when an activating voltage is applied by the energizing circuit, the resulting potential is sufficient to cause arcing between the electrodes to provide a readily apparent audible and visible warning display.

In some embodiments, the cane has at least one pair of side electrodes that are located in the tip region, and positioned along the exterior surface of the support shaft. These side electrodes are also connected to the energizing circuitry and their separation can be adjusted such that, when the electrodes are energized, the potential between the electrodes causes visible arcing therebetween. Furthermore, when contact is made with the aggressor, the electrodes will discharge through the aggressor and stun the aggressor. These side electrodes are intended for use when the aggressor is too close to allow the end of the cane to be used for discharging the potential therebetween, or in the event that the aggressor grasps the tip region of the support shaft while attempting to take the cane from the user. These electrodes can be configured to appear as a decorative element of the cane.

When elastomer conductors are employed for the tip electrodes, it is preferred that the gap between the side electrodes be adjusted such that discharge in air will occur first between the side electrodes. This can extend the useful life of the elastomer tip electrodes by avoiding air discharge between the elastomer conductors, which would otherwise tend to volatilize the arcing surfaces of the tip electrodes over time. Arcing on the sides may also provide a sufficiently alarming visual and audible display to deter an aggressor from advancing or from attempting to disarm the user. If not, then once the tip electrodes or the side electrodes are placed against the body of the aggressor, the contacting electrodes will stun the aggressor by passing a current through the body of the aggressor.

The cane can be designed to provide an additional benefit when provided with an annular light source directed along the support shaft towards the cane tip. This light source can aid the user in identifying an individual to assess whether the individual presents a threat, as well as to illuminate the ground surface over which the user traverses. If sufficiently bright, the light may also serve as a dazzling and confusion-causing deterrence by making it difficult for the attacker to see clearly.

When an annular light is incorporated into the support shaft of the cane, in some embodiments the support shaft has a stepped cross-section, with a lower shaft extension section that terminates in the cane tip being smaller than an upper base section attaching to the grip. A coupling unit is provided between the two sections, and a means for illuminating the tip of the cane and an annular region thereabout is provided.

In one embodiment, the coupling unit has a tubular element having an inner cross section configured to grippably engage the shaft extension section. An extension section stop is provided to limit the depth to which the shaft extension section penetrates the tubular element. The outer cross section of the tubular element is configured such it will grippably engage a passage in the shaft base section of the support shaft. Again, a base section stop is provided to limit the depth of penetration of the tubular element into the shaft base section.

The tubular element of the coupling unit is fabricated from a light-transmitting material. The means for illuminating the cane tip and an annular region thereabout employs an LED lamp to generate light, the LED lamp being housed in a light receptor. Means are provided for transmitting the light from the light receptor and redirecting it so as to pass down the tubular element. Such can be provided by connecting the tubular element to the LED receptor with a series of light pipes or, alternatively, by an annular lens configured to have reflection surfaces that redirect the light so that it passes down the tubular element; in this latter case, the annular lens and the tubular element could be fabricated as an integral coupling unit.

While this annular light has been described as a complementary feature of the cane, it should be appreciated that annular light source would have utility in and of itself when integrated into a cane.

BRIEF DESCRIPTIONS OF THE FIGURES

FIG. 1 is an isometric view of one embodiment of a cane of the present invention. The cane has a cane tip that incorporates a pair of tip electrodes that are provided with an electrical potential therebetween by an energizing circuit housed within a support shaft of the cane. The energizing circuit in turn is provided electrical power from batteries housed in a grip via a switch that is also mounted on the grip.

FIGS. 2 and 3 are sectioned isometric views of the cane tip of the cane shown in FIG. 1, showing further details of the electrodes. The electrodes are formed as rings fabricated from a conductive elastomer, each of the rings contacting a metal electrode support element to which a power lead from the energizing circuit is connected. The elastomer rings are embedded in an elastomer tip element (shown in Phantom in FIG. 2) so as to reside behind a support surface of the cane tip. The metal electrode support elements are configured to have overlapping footprints to avoid creating shear planes in the cane tip, and to provide more consistent support across the cane tip whenever the cane is employed to support the weight of the user.

FIG. 4 is an isometric view of a cane that forms another embodiment of the present invention, which again has a pair of energized elastomer tip electrodes located on a cane tip; however, in this embodiment the electrodes protrude slightly beyond the support surface of the cane tip. In this embodiment, the support shaft is stepped in cross section with a shaft extension section that terminates in the tip being smaller than a shaft base section attaching to the grip. A coupling unit is provided with a means for illuminating the tip of the cane and an annular region thereabout. In this embodiment, the tip electrodes are formed from conductive elastomer and again are recessed with respect to a support surface of the cane tip. To extend the useful life of the conductive elastomer material of the tip electrodes, this embodiment is provided with a pair of side electrodes that are spaced apart such that, when the energizing circuit is activated, an arc is preferentially provided between the side electrodes. With such spacing, the arcing occurs between the side electrodes until such time as the cane tip is in sufficiently close proximity to an aggressor for the arc to jump, via the tip electrodes, to the body of the aggressor. The electrodes of this embodiment are formed by cutting diagonally through a length of conductor sized to slidably engage the support shaft. This embodiment also includes an annular light source on the shaft to aid the user in traversing uneven ground and in identifying an approaching individual to aid in determining whether or not the individual poses a threat.

FIG. 5 is a view of the section 5-5 of FIG. 4, showing further details of the side electrodes. Because the electrodes are milled by a diagonal cut, the profile of the electrode edge that is opposed to the other side electrode has an obtuse inner corner residing against the support shaft and an acute outer corner that is raised above the surface of the support shaft. Electrical arcing tends to occur where the angle is sharpest, and thus occurs at the upper corner, reducing any effect of moisture which may collect on the shaft, since such moisture tends to collect against the support shaft at the lower corner.

FIG. 6 is an exploded partial section view of the support shaft of the cane shown in FIGS. 4 and 5, illustrating details of the coupling unit and its means for illuminating the tip of the cane and an annular region thereabout. In this embodiment, the coupling unit is a lens having a central cavity configured to grippably engage the shaft extension section while the larger shaft base section has a shaft passage configured to grippably engage the external surface of the coupling unit. FIG. 6 shows the elements of the support shaft when exploded, while FIG. 4 shows the shaft when assembled.

FIG. 7 is a partial isometric view of an embodiment similar to that shown in FIGS. 4-6, but which has a grip configured to shield the switch to prevent inadvertent activation of the electrodes.

FIGS. 8 and 9 illustrate an alternative coupling unit which enhances the structural integrity of the support shaft and offers improved optical performance. The coupling unit serves as a lens configured to act as a light guide to redirect the light from an LED lamp from an axial direction first to a radial direction and then back to an axial direction, but at a greater radius from a central axis of the lens. In this embodiment, the shaft extension section of the support shaft, the lens, and the shaft base section of the support shaft have a pin passing therethrough to eliminate any shearing forces on the coupling unit resulting from loading of the support shaft.

FIGS. 10-13 illustrate some possible alternative configurations of side electrodes that can be employed to protect the tip electrodes from deterioration, as well as to provide a desired decorative appearance.

FIG. 14 is a partial isometric view showing a portion of a support shaft that employs an array of optical fibers to receive and redirect light from an LED lamp. A lens is also employed, to adjust the distribution of the emitted light as well as to serve as part of a coupling unit between the sections of the shaft.

DETAILED DESCRIPTION OF THE PREFERRED EMBODIMENTS

Figure 1:
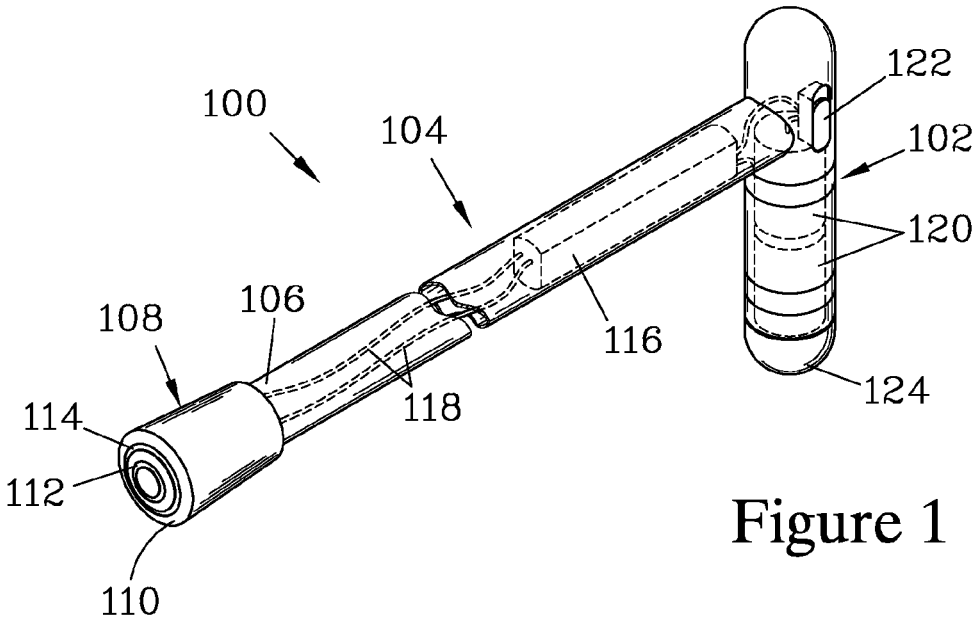
Figure 2:
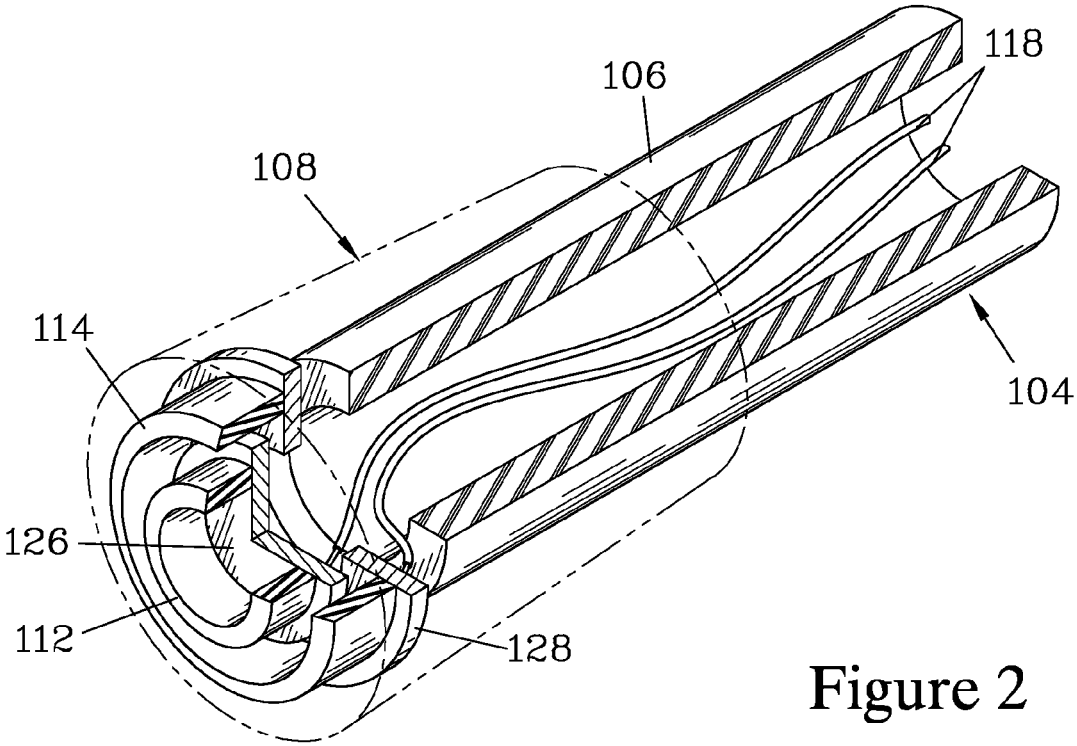
Figure 3:
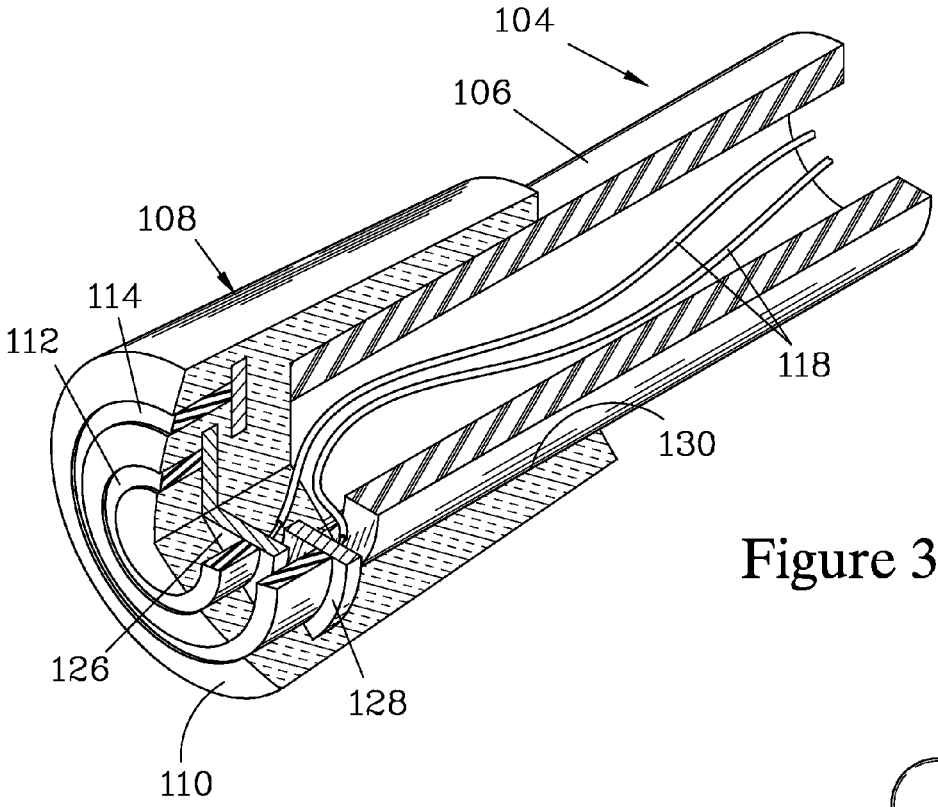

FIGS. 1-3 illustrate a cane 100 which forms one embodiment of the present invention. The cane 100 has a grip 102 which is attached to a support shaft 104 terminating in a tip region 106. A cane tip 108 fabricated from an elastic material is mounted to the tip region 106 of the support shaft 104. The cane tip 108 in turn terminates in a support surface 110 (better shown in FIG. 3) which is designed to grippably engage an underlying surface on which it rests when a downward force is applied to the cane tip 108 by a user who is employing the cane 100 to provide balance or ambulatory support.

The cane 100 has a pair of tip electrodes (112, 114) embedded in the cane tip 108, which can be discharged into an aggressor to stop the aggressor's advance. A high-voltage potential is created across the electrodes (112, 114) by an energizing circuit 116 housed within the support shaft 104 and connected to the electrodes (112, 114) by wiring 118. The energizing circuit 116 in turn is provided electrical power from batteries 120 housed in the grip 102, via a switch 122 that is mounted on the surface of the grip 102. Such energizing circuits for electrical deterrents are known in the art, and typically employ an oscillator to convert the battery power to an AC current which is then provided to a series of step-up transformers to increase the voltage, with the secondary winding of the last transformer being connected to the electrodes.

The switch 122 is preferably a momentary-on switch that only supplies electrical power while depressed by the user, thereby preventing the user from inadvertently setting the cane 100 down while activated. The energizing circuit 116 can be designed to automatically pulse the electrical power supplied to the electrodes to conserve battery power. The grip 102 has a screw-off cap 124 to allow access to replace the batteries 120. If rechargeable batteries such as lithium iron phosphate batteries are to be employed, the grip 102 should be configured to allow recharging the batteries 120 without requiring them to be removed; suitable techniques for recharging batteries while they remain inside a housing are well known in the art.

FIGS. 2 and 3 are partial section views showing further details of the tip electrodes (112, 114) of the cane 100; FIG. 2 shows the structure with the elastomer material of the cane tip 108 shown in phantom, while FIG. 3 shows this material sectioned. The electrodes (112, 114) are formed as rings fabricated from a conductive elastomer, each of the rings contacting a metal electrode support element (126, 128) to which the wiring 118 is connected. The electrodes (112, 114) and the metal electrode support elements (126, 128) are in turn embedded in an elastomer material that forms the cane tip 108 (shown in FIG. 3), with the electrodes (112, 114) positioned such that their exposed surfaces are slightly recessed from the support surface 110. Recessing the electrodes (112, 114) should reduce premature wear in the event that the conductive elastomer material employed is significantly softer than the surrounding material of the cane tip 108, as well as reducing susceptibility to separating from the surrounding material due to flexing as the cane tip 108 is employed to provide functional support for the user. Further resistance to separation can be provided by adhering the electrodes (112, 114) to the surrounding material of the cane tip 108 with a suitable adhesive. Recessing the electrodes (112, 114) may also aid in keeping them dry when the cane 100 is employed on a damp surface. The use of a conductive elastomer for the electrodes (112, 114) maintains a high degree of flexibility and resilience for the support surface 110, providing enhanced engagement with a ground or floor surface to resist slipping when the cane 100 is employed to support the user.

One example of conductive elastomer material which could be employed for the electrodes (112, 114) is the silver-bearing elastomer material employed for making RFI shielding gaskets used to prevent electromagnetic signals from being emitted from electronic equipment. One source of such RFI shielding elastomer material is Chomerics North America of Woburn, Mass. Alternative materials, such as elastomers bearing copper, graphite, or other conductive substances, might be employed, and might be developed to provide superior resistance to degradation due to arcing.

The metal electrode support elements (126, 128) are axially spaced apart but are configured to overlap, such that an axial projection of either is partly superimposed on the other. This overlap prevents the creation of sheer planes within the elastomer material of the cane tip 108, and helps to distribute forces on the elastomer material caused by weight applied to the support shaft 104, which is frictionally received in a tip recess 130 in the cane tip 108 (shown in FIG. 3). The elastomer material of the cane tip 108 must be an electrically insulating material to isolate the axially-separated metal electrode support elements (126, 128) from each other to prevent arcing within the cane tip 108 when voltage is applied to the metal electrode support elements (126, 128).

The metal electrode support elements (126, 128) also provide a material to which the wiring 118 can be readily connected by conventional techniques such as soldering. In turn, electrical connectivity with the electrodes (112, 114) can be provided by simple contact; however, more positive continuity can be provided by employing a conductive adhesive such as a graphite-filled epoxy to secure each of the electrodes (112, 114) to its corresponding metal electrode support element (126, 128). In the cane 100 illustrated, the metal electrode support element 128 is formed as a washer, allowing the wiring 118 to pass through to connect to the metal electrode support element 126, which is formed as a solid disk.

Figure 4:
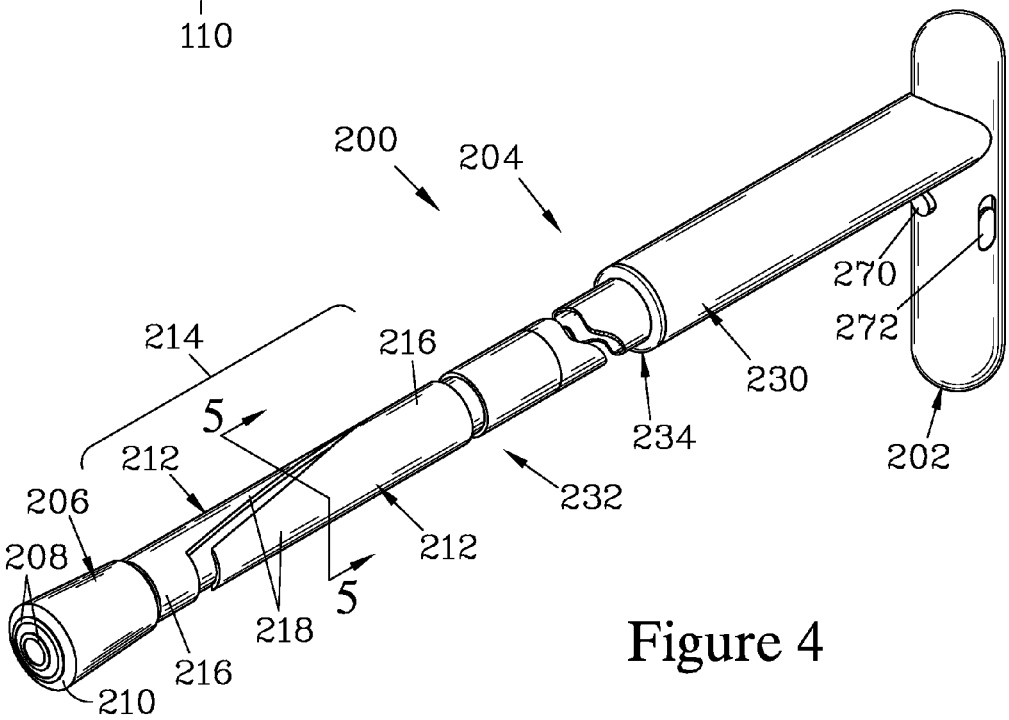
Figure 5:
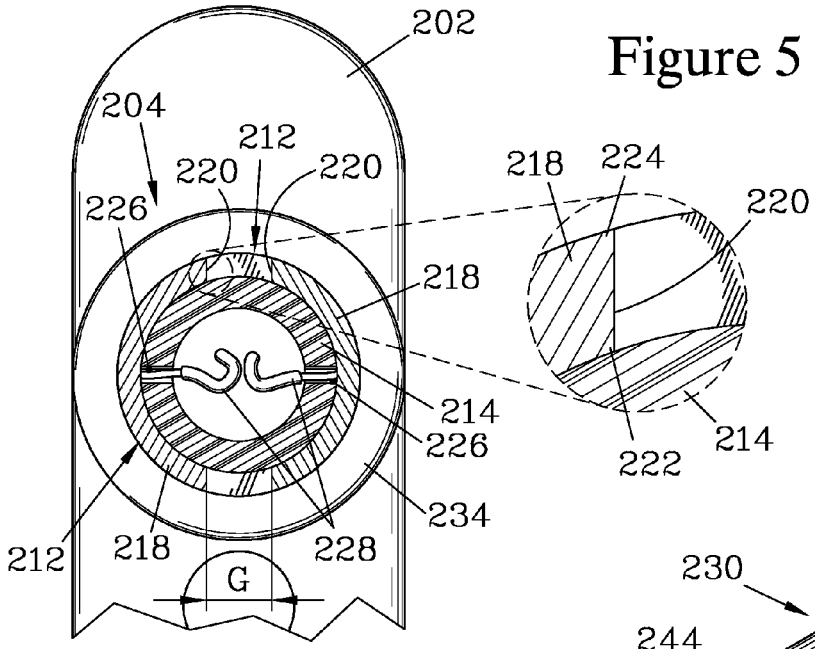
Figure 6:
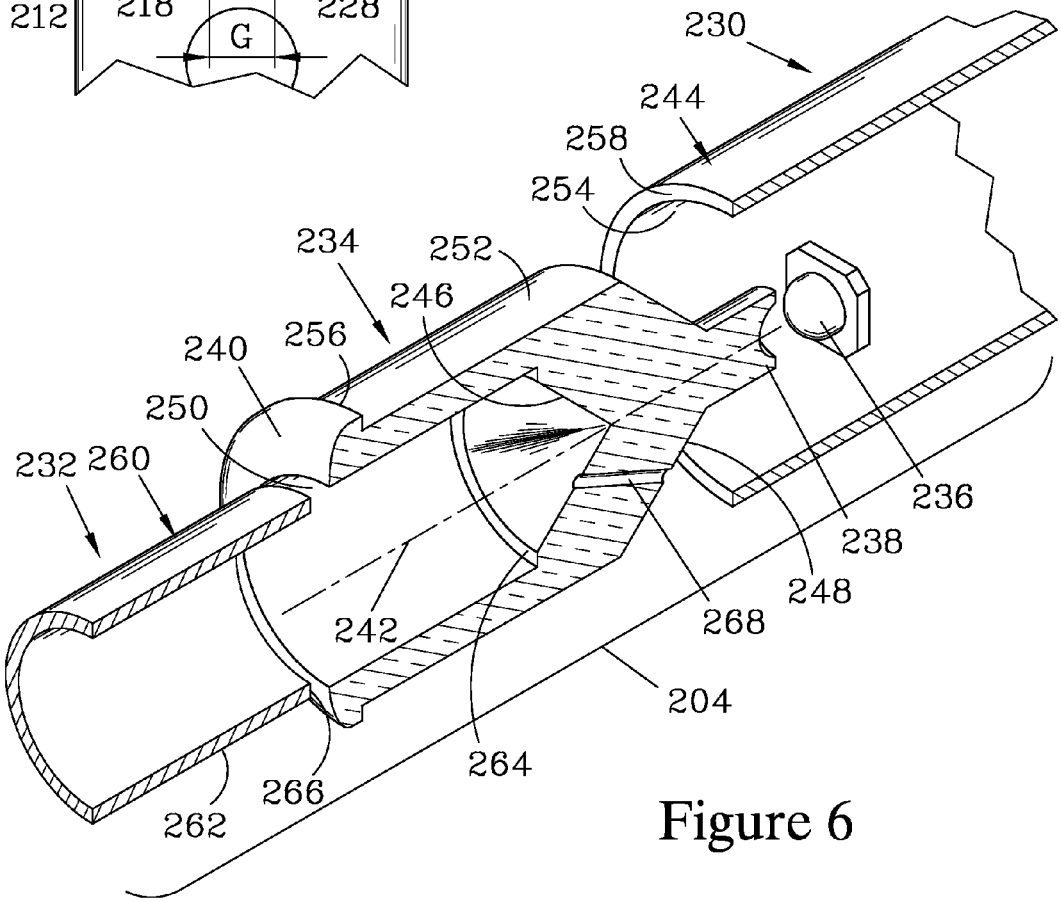

FIGS. 4-6 illustrate a cane 200 that forms another embodiment of the present invention, which includes additional electrodes as well as a means for illuminating the tip of the cane and an annular region adjacent thereto. The cane 200 again has a grip 202 and a support shaft 204, with a cane tip 206 mounted to the support shaft and having two tip electrodes 208 mounted therein. In this embodiment, the tip electrodes 208 protrude slightly beyond a support surface 210 of the cane tip 206 to positively assure that, when the cane tip 206 is pushed against an attacker, the tip electrodes 208 are brought into contact with the body of the attacker. When the tip electrodes 208 protrude in this manner, it is important that they be made from a compliant material such as a conductive elastomer to provide traction and to prevent marring floor surfaces.

In addition to the tip electrodes 208, the cane 200 has two side electrodes 212 that are mounted on a tip region 214 of the support shaft 204, the tip region 214 being formed from an electrically-insulating material or having an insulating surface material. The side electrodes 212 are formed from tubular stock of a conductive material such as aluminum, and are formed with a side electrode base portion 216 that forms a complete cylinder about the support shaft 204 and a side electrode tapered portion 218 that extends along the support shaft 204 in opposition to the side electrode tapered portion 218 of the other side electrode 212. The tapered portions 218 can be formed by milling the tubular stock at an angle so as to produce parallel opposed faces 220 of the side electrodes 212, as shown in FIG. 5. A milling angle of about 5-10° relative to the length of the support shaft 204 is felt to provide an effective tapered profile. Since the cut edges form a curve, the consistency of the separation between the opposed faces 220 increases as the angle at which they are cut decreases, employing a relatively shallow angle of cut results in the spacing of the opposed faces 220 being sufficiently consistent along the length of the tapered portions 218 that an electrical arc caused by electrical potential therebetween can move freely along the length.

As shown in the section view of FIG. 5, cutting the tapered portions 218 at an angle results in the opposed faces 220 being parallel. Each of the opposed faces 220 is bounded by a lower corner 222, which resides against the tip region 214 of the support shaft 204, and an upper corner 224. Because the upper corners 224 are acute angles where electrical charge concentrates, arcing will tend to occur between the upper corners 224, reducing untoward effects caused by moisture that collects on the cane 200 when employed in damp environs such as dewy grass or slush-covered walkways, since such moisture will tend to collect at the juncture of the lower corner 222 and the support shaft 204. FIG. 5 also shows two wiring passages 226 that are provided through the tip region 214 to allow wiring 228 to connect to the side electrodes 212.

To assure that arcing occurs preferentially between the side electrodes 212 rather than between the tip electrodes 208, the separation between the opposed faces 220 can be adjusted by adjusting the relative axial positions of the side electrodes 212 along the tip region 214 of the support shaft 204. An appropriate separation can be set to assure arcing initially occurs between the side electrodes 212 and is only readily transferred to the tip electrodes 208 when they are brought into close proximity or contact with an aggressor. Having arcing occur on the side electrodes 212 can not only extend the useful life of the cane tip 206 by avoiding premature deterioration of the conductive elastomer material of the tip electrodes 208 caused by prolonged arcing therebetween, but also tends to deter an attacker from attempting to grasp the support shaft 204. In a prototype, it was found that even when the tip was sufficiently damp as to cause weak sparking at the tip rather than on the sides, the electrical arc would still transfer effectively to a simulated attacker when prodded by the cane tip. An alternative embodiment that may provide improved performance in damp conditions is discussed below in the description of FIG. 17.

Referring again to FIG. 4, the support shaft 204 is formed with a shaft base section 230, which attaches to the grip 202, and a shaft extension section 232, on which the tip region 214 is provided; this stepped configuration provides an enlarged cross section in the shaft base section 230 to more readily house electronic components. These sections are connected together by an annular lens 234 which serves as a coupling unit; as better illustrated in FIG. 6, the annular lens 234 also serving as means for distributing light generated by an LED lamp 236 about the shaft extension section 232. The light can allow a user to illuminate an approaching individual to evaluate the threat posed by the individual, and can also provide a benefit when the cane is used as a support device, by illuminating the ground or floor surface without substantial shadowed areas to enable the user to discern obstacles. This latter function could provide a benefit even for canes which do not include an electrical deterrent.

The annular lens 234 has a lens base end 238 and a lens emitting end 240, and is symmetrically disposed about a lens axis 242. The lens base end 238 resides within a base section terminal end region 244 of the shaft base section 230 and is configured to receive light from the LED lamp 236. A clear optical gel could be employed between the LED lamp 236 and the lens base end 238 to improve light transmission from the LED lamp 236 into the annular lens 234. A high-output white LED lamp can be selected to provide a desirable degree of brightness, and may serve to disorient or deter an aggressor when the resulting light is directed into the eyes of the aggressor. The light received from the LED lamp 236 is directed into the annular lens 234 to a conical reflector 246 of the annular lens 234. The annular lens 234 also has a lens base reflecting surface 248, a lens inner cylindrical surface 250, and a lens outer cylindrical surface 252. The conical reflector 246 and the base reflecting surface 248 serve to redirect the light so that it exits through the lens emitting end 240, as discussed below. To reduce light loss, the conical reflector 246 and the base reflecting surface 248 should be surfaces of rotation defined by parallel line segments rotated about the lens axis 242 such that they have the same angle of inclination with respect to the lens axis 242.

The annular lens 234 serves both to redirect the light and to provide a mounting element to stabilize and support the shaft extension section 232 with respect to the shaft base section 230. The base section terminal end region 244 has a base terminal end inner surface 254 that is configured to slidably engage the lens outer cylindrical surface 252. The base terminal end inner surface 254 is polished to serve as a reflecting surface to reflect back any light that exits through the lens outer cylindrical surface 252. The annular lens 234 also has a lens outer ledge 256 that is adjacent to the lens outer cylindrical surface 252 so as to supportably engage against a base section terminal surface 258 of the base section terminal end region 244. The shaft extension section 232 has an extension base end region 260 with an extension base end outer surface 262 that is configured to slidably engage the lens inner cylindrical surface 250, and which is polished to reflect back any light that exits from the lens inner cylindrical surface 250. A lens inner ledge 264 is positioned adjacent to the lens inner cylindrical surface 250 and the conical reflector 246 so as to supportably engage an extension terminal surface 266 of the extension base end region 260.

The conical reflector 246, the lens base reflecting surface 248, the base terminal end inner surface 254, and the extension base end outer surface 262 are configured to direct the light received through the lens base end 238 such that substantially all the light is directed out from the lens emitting end 240. The light from the LED lamp 236 is directed predominantly to the conical reflector 246, which in turn reflects this light such that most of the light strikes the base reflecting surface 248. The base reflecting surface 248 then reflects this light to the lens emitting end 240. Stray light that passes through one of the lens cylindrical surfaces (250, 252) is reflected by either the base terminal end inner surface 254 or the extension base end outer surface 262 back into the lens 234, such that substantially all of the light is eventually directed out the lens emitting end 240. The lens emitting end 240 is configured to direct the emitted light substantially parallel to the lens axis 242, with a slight outward divergence so as to create a distribution of light substantially parallel to and surrounding the shaft extension section 232. Because the light is emitted around the circumference of the shaft extension section 232, the shaft extension section 232 will not cast shadows, providing complete illumination to show obstacles on the surrounding ground surface.

To allow access for the wiring 228 extending from a power supply (not shown) to the electrodes (208, 212) provided on the shaft extension section 232, the annular lens 234 is provided with one or more wire passages 268 that extend from the lens base reflecting surface 248 to the conical reflector 246.

Referring again to FIG. 4, the cane 200 is provided with separate switches (270, 272) located on the grip 202 for selectively activating the electrodes (208, 212) and the LED lamp 236 (shown in FIG. 6). The switch 270 that serves to cause energizing of the electrodes (208, 212) is a momentary-on push-button switch that is conveniently located so as to be readily depressed by the fingers of the user when grasping the grip 202, while the switch 272 for activating the LED lamp 236 is a sliding switch, allowing the user to maintain the LED lamp 236 activated without having to maintain a grasp on the grip 202.

Figure 7:
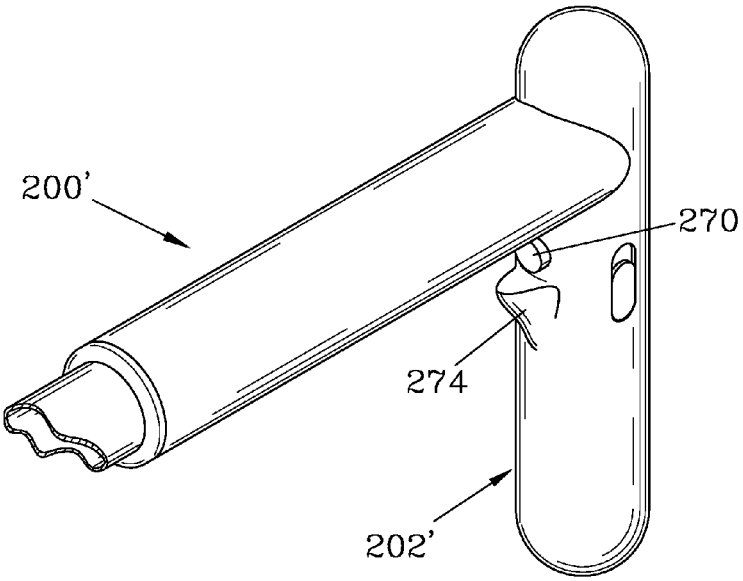

FIG. 7 is a partial view of a cane 200' that is similar to the cane 200 shown in FIG. 4, but which has a grip 202' that is contoured to provide a guard 274 that serves to prevent the fingers of the user from inadvertently depressing the switch 270. The guard 274 thus prevents activation of the electrodes (not shown) unless the user takes deliberate action to place their finger over the switch 270 to depress it. One example of an alternate switch configuration that avoids inadvertent activation is discussed below with regard to FIGS. 15 and 16.

Figure 8:
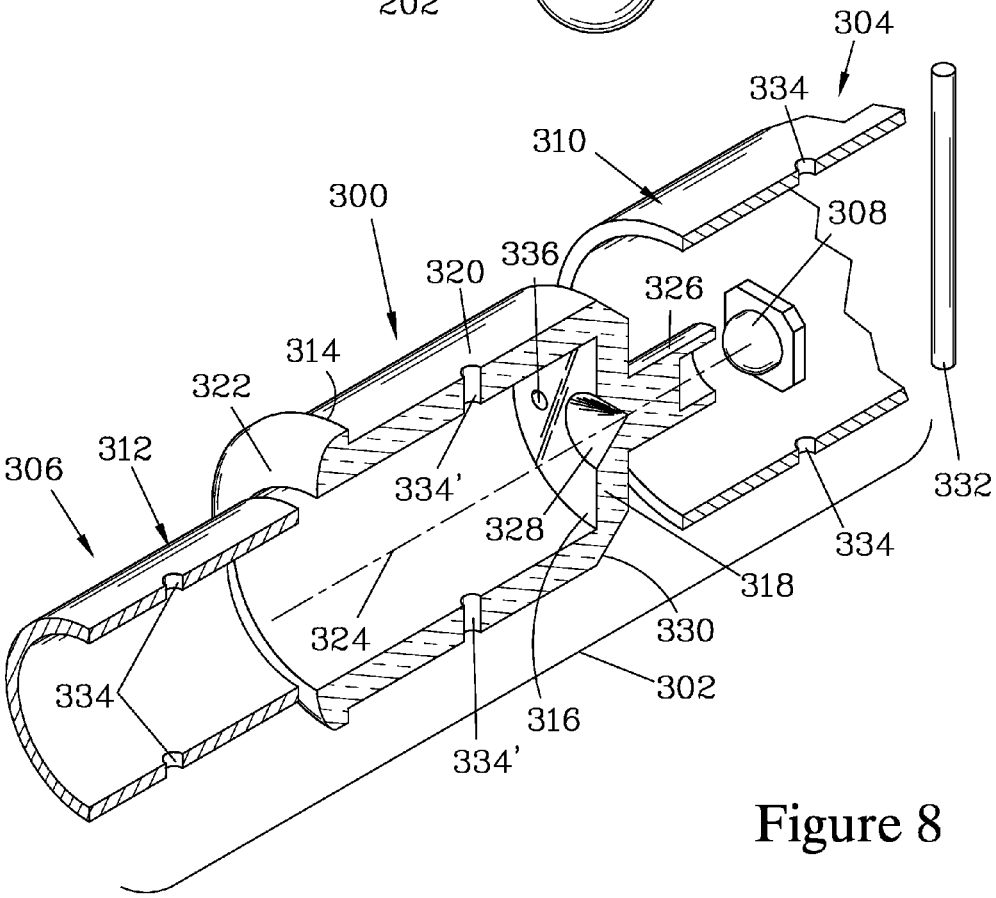
Figure 9:
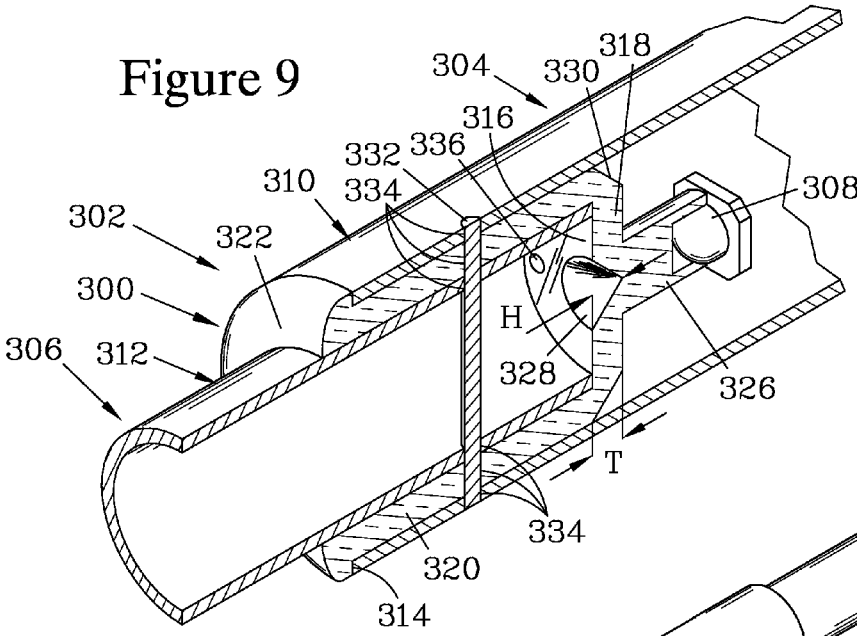

FIGS. 8 and 9 illustrate an alternative annular lens 300 that can be employed in a support shaft 302 as part of a coupling structure that connects together a shaft base section 304 and a shaft extension section 306. Again, the annular lens 300 also serves to distribute light generated by an LED lamp 308 about the shaft extension section 306. The annular lens 300 is designed to provide improved optical performance and reduced cost compared to the lens 234 shown in FIG. 6.

The annular lens 300 is slidably insertable into a base section terminal end region 310 of the shaft base section 304 and is configured to slidably accept an extension base end region 312 of the shaft extension section 306. Again, the annular lens 300 is provided with a lens outer ledge surface 314 that supportably engages the base section terminal end region 310 and a lens inner ledge surface 316 that supportably engages the extension base end region 312.

The lens 300 is formed generally as a cylindrical cup, having a lens base section 318 extending normal to a lens cylindrical section 320 that terminates at a lens emitting end 322; the lens 300 is symmetrically disposed about a lens axis 324. A light receptor 326 attaches to the lens base section 318 and directs light emitted by the LED lamp 308 to a conical reflector 328 that is formed in the lens base section 318 and centered on the lens axis 324. The conical reflector 328 is formed as a 45° cone with a height H that is about equal to a thickness T of the lens base section 318, such that essentially all the light from the LED lamp 308 hitting the conical reflector 328 is directed radially outward in the lens base section 318. The lens base section 318 terminates in a base beveled surface 330 that is a section of a 45° cone, and which reflects essentially all the light it receives into the lens cylindrical section 320, directed parallel to the lens axis 324 so as to be directed to the lens emitting end 322. To enhance the reflective properties of the conical reflector 328 and the base beveled surface 330, it is preferred for the exterior of these surfaces to have a reflective coating applied thereon. In fact, all surfaces of the lens 300 other than the light-receiving surfaces of the light receptor 326 and the lens-like surface of the lens emitting end 322 can have a reflective coating applied to help maximize the amount of light that is eventually emitted from the lens emitting end 322. The lens emitting end 322 is again configured to direct the emitted light substantially parallel to the lens axis 324, with a slight outward divergence to distribute the emitted light around the shaft extension section 306.

Because the lens 300 has an overall thinner structure than the lens 234 shown in FIG. 6, and has a particularly thin structure at the base beveled surface 330, it may be desirable to provide additional structure to transfer a load applied in service between the shaft extension section 306 and the shaft base section 304 to assure that the support shaft 302 is able to support the weight of the user. In the support shaft 302, a transfer pin 332 is provided, which passes through pin passages 334 in the shaft extension section 306, the lens 300, and the shaft base section 304 in order to transfer forces directly between the shaft base section 304 and the shaft extension section 306 without relying on the structural integrity of the lens 300. The pin passages 334' that extend through the lens cylindrical section 320 may cause minor shadowing in the emitted light, but the distribution is typically sufficient that such shadows do not significantly impede the ability of the emitted light to illuminate a potential aggressor or a ground surface.

To allow access for the wiring (not shown) to pass through the lens 300, one or more wire passages 336 are provided through the lens base section 318, which again may result in some minor shadowing. The shadowing can be reduced when it is desired to provide a more widely distributed pattern of emitted light by frosting or otherwise treating the emitting surface of the lens to cause the emitted light to radiate from the lens surface rather than being directed by the lens.

Figure 10:
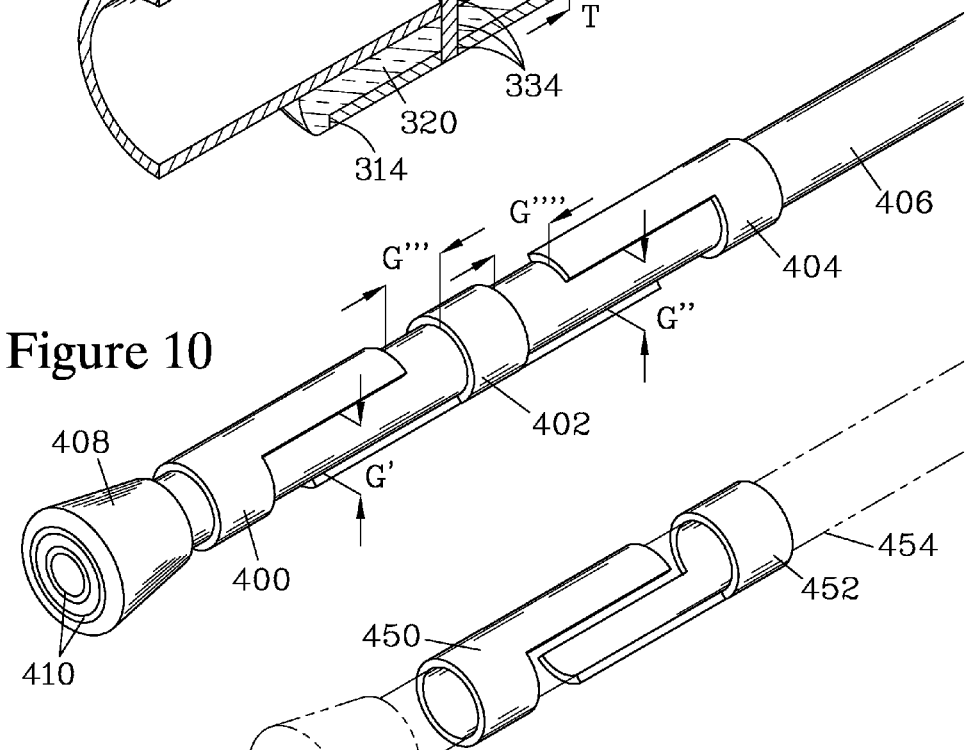

FIGS. 10-13 illustrate various alternative configurations of side electrodes that can be employed on a support shaft to provide a desired decorative appearance. FIG. 10 shows three electrodes (400, 402, and 404), where a voltage is created between the center electrode 402 and the bracketing electrodes (400, 404). The center electrode 402 in this embodiment is preferably provided at least a limited degree of rotation on a support shaft 406, allowing simultaneous adjustment of the gap G' between the center electrode 402 and the first bracketing electrode 400 and the gap G" between the center electrode 402 and the second bracketing electrode 404. It is further preferred for the bracketing electrodes 400 and 404 to be longitudinally adjustable so that the gaps G'" and G"" can also be adjusted. Adjusting the size of the gap between adjacent electrodes varies the voltage required to generate an arcing spark therebetween, and can determine whether sparks are generated on the support shaft 406 or on a cane tip 408. It is preferred for the sparks to be displayed along the support shaft 406, to distract an aggressor from the tip 408 and to prevent undue degradation of concentric tip electrodes 410 embedded in the cane tip 408 when these tip electrodes 410 are formed from a conductive elastomer.

Figure 11:
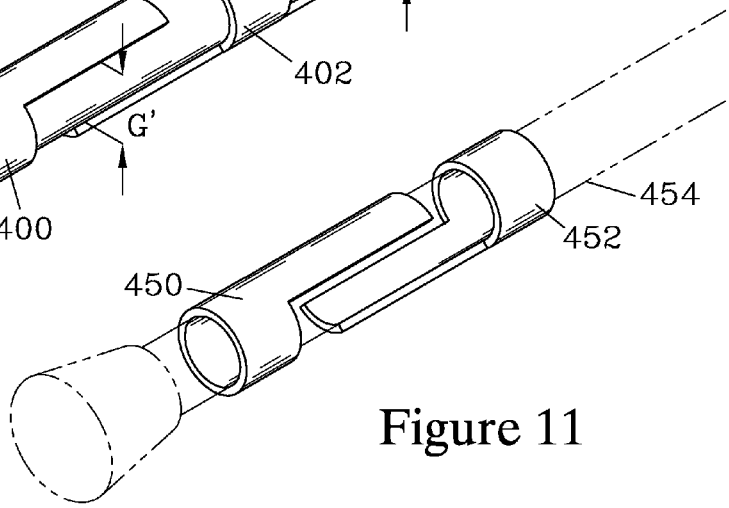

FIG. 11 illustrates another side electrode configuration which can be employed. In this configuration, a pair of side electrodes (450 and 452) are substituted for the three electrode configuration (400, 402, and 404) shown in FIG. 10. This configuration is felt to be less functionally practical than the configuration shown in FIG. 4, as adjustment of the gap between the side electrodes (450, 452) cannot be made consistent on both sides of a support shaft 454 (shown in phantom) by longitudinally sliding the side electrodes (450, 452) relative to each other; in this embodiment, adjustment is made by rotating one of the side electrodes (450, 452), with the result that as the gap on one side is reduced, the gap on the other side increases, so arcing will occur preferentially on just one side of the support shaft 454.

FIG. 12 shows a configuration where alternating ring-shaped electrodes (500, 502) encircle a support shaft 504. In this embodiment, adjustment of the gaps G between adjacent electrodes (500, 502) can be adjusted if the positions of the electrodes (500, 502) are longitudinally adjustable along the shaft 504; such could be accomplished by threadably mounting the electrodes (500, 502) on the shaft 504.

FIG. 13 shows an alternative embodiment where the separation between two side electrodes 550 is not adjustable, and must be carefully preset. The electrodes 550 are helically-positioned on a support shaft 552, having a fixed gap G therebetween. Again, the gap G should be selected such that arcing sparks are generated preferentially along the support shaft 552 rather than across tip electrodes 554. The electrodes 550 of this embodiment can be flush with the surrounding surface of the support shaft 552 to provide a more finished appearance.

FIG. 14 illustrates a section of a support shaft 600 that employs an alternative means for receiving light generated by an LED lamp 602, which is housed in a shaft base section 604, and redirecting the light so as to emit the light about a shaft extension section 606 in a direction substantially parallel to a shaft axis 608. In this embodiment, such means is provided by an array 610 of optical fibers 612 in combination with an annular lens 614.

Each of the optical fibers 612 terminates in a fiber receiving end 616 and a fiber emitting end 618. The fiber receiving ends 616 are bundled side by side in a collar 620 and are positioned to receive the light generated by the LED lamp 602. To reduce light loss, an optical gel (not shown) can be placed between the LED lamp 602 and the fiber receiving ends 616. The optical fibers 612 are arranged such that they spread out and surround an extension section base end region 622 of the shaft extension section 606, and are positioned such that the fiber emitting ends 618 are evenly distributed about the extension section base end region 622 and oriented to direct the light emitted from the fiber emitting ends 618 in a direction substantially parallel to the shaft axis 608. In this manner, the array 610 serves to receive and redirect the light to emit it in a distribution about and substantially parallel to the shaft extension section 606.

While the array 610 should serve to adequately redirect the light generated by the LED lamp 602, the distribution of the emitted light can be further adjusted by the annular lens 614. The annular lens 614 also provides a solid spacing element between the shaft base section 604 and the shaft extension section 606 to maintain these sections (604, 606) concentric. Since the light is distributed about the extension section base end region 622 by the array 610, the annular lens 614 can be much simpler in structure than the annular lenses (234, 300) discussed above. The annular lens 614 of this embodiment is substantially cylindrical, having a lens base end 624 that contacts the fiber emitting ends 618 of the optical fibers 612 to receive the light emitted therefrom. To reduce loss of light, the fiber emitting ends 618 can be attached to the lens base end 624 by an optical adhesive or the fiber emitting ends 618 can be placed against the lens base end 624 with an optical gel interposed therebetween. The lens 614 also has a lens emitting end 626 that circumscribes the extension section base end region 622 to provide the desired distribution of emitted light.

While the embodiments discussed above employ a single LED light source combined with means for distributing the light around the shaft, alternative structures for providing an annular distribution of light could be employed, such as an annular array of LED's or an annular luminescent screen surrounding the extension section base end region of the shaft.

Figure 15:
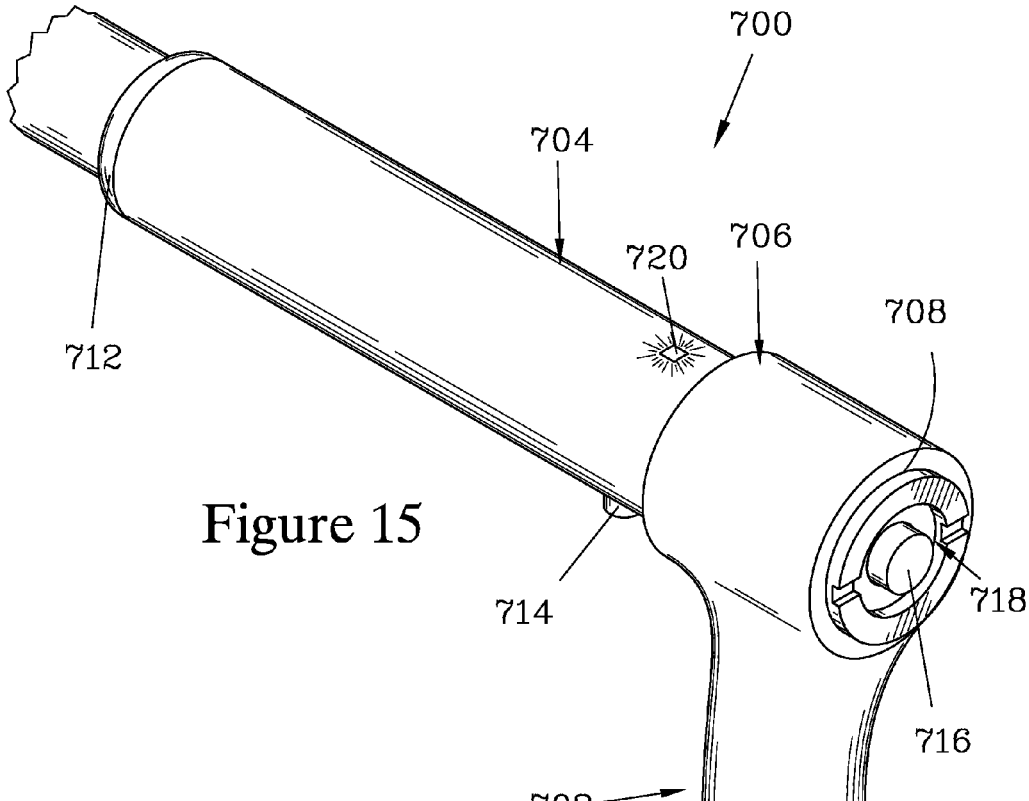
FIGS. 15 and 16 are partial isometric views illustrating another embodiment of the present invention, which provides a handle that can be readily replaced to conform to the hand of the user, and which employs an alternate position for switches used to selectively activate an LED lamp and a set of electrodes.

FIG. 15 is an isometric view of a portion of a cane 700 that forms another embodiment of the present invention. The cane 700 again has a grip 702 and a support shaft 704, the support shaft 704 having a cane tip region (not shown) with electrodes for providing an electrical deterrent. The grip 702 of this embodiment is readily replaceable to allow adapting the cane 700 to be comfortably gripped by the hand of an individual user.

The grip 702 has a base portion 706 with a grip passage 708 therethrough, the grip passage 708 being sized to slidably engage the support shaft 704. The grip 702 also has a contoured handle portion 710 that is ergonomically configured to be comfortably grasped by a user. Since the grip 702 is replaceable, the contoured handle portion 710 can be sized to match the hand of the intended user.

The support shaft 704 of this embodiment again incorporates an annular light source 712 to illuminate the surface over which the user traverses as well as to illuminate the environs and/or potential aggressors. The support shaft 704 has a light switch 714 that is conveniently positioned near the grip 702 so as to be readily activated by the user. The light switch 714 can be provided by a conventional momentary-on push-button switch, and in such cases can be readily activated by the index finger of the user while maintaining a grasp on the contoured handle portion 710 of the grip 702. In the cane 700, the electrodes and annular light source 712 are powered by batteries (not shown) housed within the support shaft 704, so as to facilitate exchanging grips 702 and for leveraged distribution of weight.

The support shaft 704 also has an arming switch 716 that serves to allow the light switch 714 to also activate the electrical deterrent and energize the electrodes located at the cane tip. The arming switch 716 illustrated is located in a base end 718 of the support shaft 704, where it can be readily operated by the thumb of the user while grasping the contoured handle portion 710. The arming switch 716 shown is a toggling pushbutton switch that, when toggled to its "on" position, causes the momentary switch 714 to activate both the light source 712 and to energize the electrodes when depressed. When the arming switch 716 is in its "off" position, depressing the momentary switch 714 only activates the light source 712, allowing the arming switch 716 to provide a safety against accidental activation of the electrodes. Inadvertent activation of the electrodes is further avoided by the position of the arming switch 716, where it requires the user to move their thumb to operate the switch 716. In some cases, it may be desirable to reverse the position of these switches so that the cane 700 at all times requires the user's thumb to be moved in order to activate the electrodes.

To notify the user when the arming switch 716 is in its "on" position, a status indicator LED 720 can be provided that is illuminated when the arming switch 716 is on. The status indicator LED 720 can also provide an indication of the battery status, such as by blinking to indicate when the battery voltage is below a specified minimum value.

Figure 16:
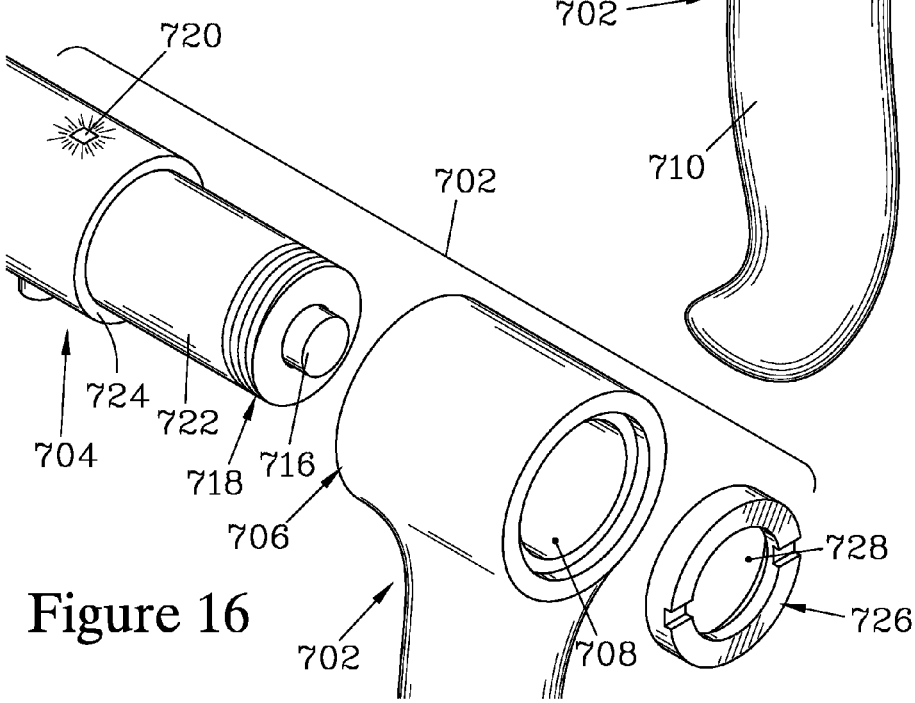

FIG. 16 is a partial exploded view showing the structure for retaining the grip 702 on the support shaft 704. The support shaft 704 has a shaft reduced section 722 sized to slidably engage the grip passage 708, and terminating at a shaft ledge surface 724; the shaft reduced section 722 can be readily provided by an insert affixed in the remainder of the support shaft 704. A retaining ring 726 threadably engages the shaft reduced section 722 and, when tightened thereon, clamps the base portion 706 of the grip 702 against the shaft ledge surface 724 to secure the grip 702 onto the support shaft 704. The retaining ring 726 has a ring central opening 728 to allow access to the arming switch 716, which is recessed to further prevent inadvertent activation of the electrodes.

Figure 17:
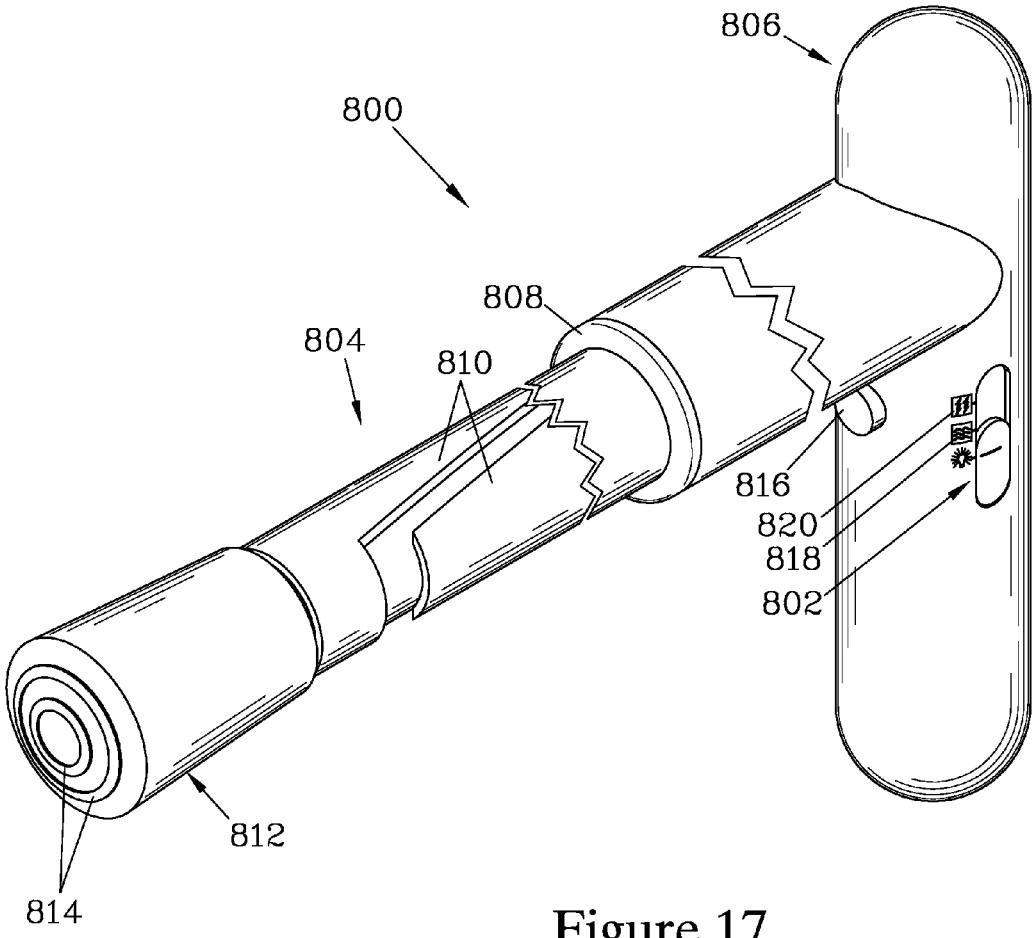
FIG. 17 is an isometric view of another embodiment, which employs a switch that allows the tip electrodes to be deactivated while retaining activation of the side electrodes, so as to preserve an uncompromised electrical deterrent whenever the cane is employed in conditions where the cane tip is likely to become damp.

FIG. 17 illustrates a cane 800 which forms another embodiment of the present invention; the cane 800 employs a three-position arming switch 802 that may provide improved performance in damp conditions. The cane 800 again has a support shaft 804 and a grip 806. The support shaft 804 has a light 808 incorporated therein, and has side electrodes 810 positioned thereon. The support shaft 804 terminates at an elastomer cane tip 812 that incorporates a pair of tip electrodes 814 that are formed of a conductive elastomer.

The arming switch 802 operates in conjunction with an activation switch 816, which is a momentary-on pushbutton switch. The arming switch 802 determines which components are activated when the activation switch 816 is depressed by the user.

When the arming switch 802 is in a first position, illustrated in FIG. 17, depressing the activation switch 816 only causes activation of the light 808. In this position, the cane 800 is safe from inadvertent activation of the electrodes (810, 814).

When the arming switch 802 is placed in a second position, depressing the activation switch 816 causes activation of the light 808 in addition to the side electrodes 810, but not the tip electrodes 814. This position is intended to enhance the performance of the cane 800 when used in damp conditions where the cane tip 812 may become wet, reducing the effective insulating gap between the tip electrodes 814. A second position indicator light 818 blinks to indicate that the arming switch 802 is in this position, providing notice to the user that the cane 800 is in an armed condition.

When the arming switch 802 is moved to a third position, indicated by a third position indicator light 820, depressing the activation switch 816 causes activation of the light 808 in addition to both the side electrodes 810 and the tip electrodes 814. However, while both sets of electrodes (810, 814) are activated, the spacing is set such that arcing initially occurs only between the side electrodes 810, and is only transferred to the tip electrodes 814 when the cane tip 812 is in close proximity to or in contact with an aggressor. Again, the third position indicator light 820 blinks to advise the user that the cane 800 is in an armed condition.

While the novel features of the present invention have been described in terms of particular embodiments and preferred applications, it should be appreciated by one skilled in the art that substitution of materials and modification of details obviously can be made without departing from the spirit of the invention.

What we claim is:

1. A cane for stabilizing a user while traversing an underlying surface, the cane comprising:

a grip;

a support shaft extending from said grip and terminating in a tip section;

a cane tip attached to said tip section, said cane tip formed of an elastic material and terminating in a support surface for grippably engaging the underlying surface;

tip electrodes embedded in said cane tip and positioned in the vicinity of said support surface so as to provide exposure to an object that contacts said support surface, wherein said tip electrodes are a pair of nested, axially aligned electrodes;

means for energizing said tip electrodes;

a switch for activating said means for energizing said electrodes on demand; and at least one pair of side electrodes positioned in a spaced apart relationship and residing on said support shaft so as to be spaced apart from said cane tip, said side electrodes also being energized by said means for energizing said tip electrodes.

2. The cane of claim 1 wherein said tip electrodes are fabricated from a conductive elastomer and said cane tip further comprises:

a first metal electrode support element attaching to one of said pair of nested electrodes, said first metal electrode support element being spaced apart from said support surface and positioned substantially parallel thereto; and a second metal electrode support element attaching to the other of said pair of nested electrodes, said second metal electrode support element being spaced apart from said support surface and positioned substantially parallel thereto and further wherein said first metal electrode support element is axially spaced apart from said second metal electrode support element and configured relative thereto such that an axial projection of said first metal electrode support element partly overlaps said second metal electrode support element.

3. The cane of claim 2 wherein said nested electrodes and said side electrodes are selectively spaced apart such that air arcing will preferentially occur between said side electrodes.

4. The cane of claim 3 wherein said side electrodes further comprise:

a first side electrode having a first side electrode base portion that encircles said support shaft and a first side electrode tapered portion extending from said first side electrode base portion;

a second side electrode having a second side electrode base portion that encircles said support shaft and a second side electrode tapered portion extending from said second side electrode base portion, said side electrode tapered portions forming a pair of opposed faces that extend substantially parallel to each other.

5. The cane of claim 4 wherein said side electrode tapered portions are configured such that said opposed faces reside substantially within a plane that is inclined with respect to a longitudinal axis of said support shaft by an angle $\alpha$ measuring between about 5° and 10°.

6. The cane of claim 5 wherein said angle $\alpha$ measures about 7°.

7. A cane for stabilizing a user while traversing an underlying surface, the cane comprising:

a grip;

a support shaft extending from said grip and terminating in a tip section;

a cane tip attached to said tip section, said cane tip formed of an elastic material and terminating in a support surface for grippably engaging the underlying surface, wherein said support shaft has, a shaft base section that attaches to said grip;

a shaft extension section terminating in said tip section;

means for transferring loads between said shaft extension section and said shaft base section;

an LED lamp; and means for illuminating an area around said cane tip with said LED lamp and providing a shadowless annular region illuminated thereabout when the LED lamp is energized;

tip electrodes embedded in said cane tip and positioned in the vicinity of said support surface so as to provide exposure to an object that contacts said support surface;

means for energizing said tip electrodes; and a switch for activating said means for energizing said electrodes on demand.

8. The cane of claim 7 wherein said means for illuminating said cane tip and an annular region thereabout is provided by a coupling unit that further comprises:

an annular lens interposed between a portion of said shaft base section and a portion of said shaft extension section, said annular lens being symmetrically disposed about a lens axis and having, a lens base end configured to receive light from said LED lamp which is housed within said shaft base section, a lens emitting end symmetrically distributed about said shaft extension section, a lens cylindrical section configured to engage said shaft base section and said shaft extension section so as to maintain said shaft sections concentric with respect to the lens axis, and reflective surfaces configured to redirect light received in said lens base end so as to exit through said lens emitting end.

9. The cane of claim 8 wherein said means for transferring loads between said shaft extension section and said shaft base section are provided, at least in part, by said coupling unit, which further comprises:

an extension section stop formed on said annular lens that limits insertion of said shaft extension section into said annular lens; and a base section stop formed on said annular lens that limits insertion of said annular lens into said shaft base section.

10. The cane of claim 9 wherein said means for transferring loads further comprises:

aligned pin passages through said shaft base section, said lens cylindrical section, and said shaft extension section; and a support pin passing through said pin passages.

11. The cane of claim 7 wherein said means for illuminating said cane tip and providing a shadowless annular region illuminated thereabout further comprises:

an array of optical fibers each having a fiber receiving end positioned to receive light emitted by said LED lamp and having a fiber emitting end that is positioned alongside said shaft extension section in close proximity to said shaft base section so as to direct emitted light substantially parallel to said shaft extension section when said LED lamp is energized.

12. A cane for stabilizing a user while traversing an underlying surface, the cane comprising:

a grip;

a support shaft extending from said grip and terminating in a tip section;

a cane tip attached to said tip section, said cane tip formed of an elastic material and terminating in a support surface for grippably engaging the underlying surface;

tip electrodes embedded in said cane tip and positioned in the vicinity of said support surface so as to provide exposure to an object that contacts said support surface;

means for energizing said tip electrodes;

a switch for activating said means for energizing said electrodes on demand;

at least one pair of side electrodes positioned in a spaced apart relationship and residing on said support shaft so as to be spaced apart from said cane tip, said side electrodes also being energized by said means for energizing said tip electrodes, and wherein said tip electrodes and said side electrodes are selectively spaced apart such that air arcing will preferentially occur between said side electrodes.

13. The cane of claim 7 wherein said switch also selectively controls energizing of said LED lamp.

* * * * *